US009702510B2

(12) United States Patent
Anderson

(10) Patent No.: US 9,702,510 B2
(45) Date of Patent: Jul. 11, 2017

(54) LED LIGHT BULB

(71) Applicant: Deloren E. Anderson, Crosslake, MN (US)

(72) Inventor: Deloren E. Anderson, Crosslake, MN (US)

(73) Assignee: YJB LED, Crosby, MN (US)

( * ) Notice: Subject to any disclaimer, the term of this patent is extended or adjusted under 35 U.S.C. 154(b) by 0 days.

(21) Appl. No.: 14/286,586

(22) Filed: May 23, 2014

(65) Prior Publication Data

US 2015/0085489 A1 Mar. 26, 2015

Related U.S. Application Data

(60) Provisional application No. 61/981,307, filed on Apr. 18, 2014, provisional application No. 61/949,878,
(Continued)

(51) Int. Cl.

| | |
|---|---|
| ***F21V 29/00*** | (2015.01) |
| ***F21K 99/00*** | (2016.01) |
| ***F21V 19/00*** | (2006.01) |
| ***F21V 31/04*** | (2006.01) |
| ***F21K 9/23*** | (2016.01) |
| ***F21K 9/232*** | (2016.01) |
| ***F21K 9/60*** | (2016.01) |
| *F21V 3/00* | (2015.01) |

(Continued)

(52) U.S. Cl.

CPC ..... *F21K 9/1355* (2013.01); *F21K 9/23* (2016.08); *F21K 9/232* (2016.08); *F21K 9/60* (2016.08); *F21V 19/003* (2013.01); *F21V 31/04* (2013.01); *F21V 3/00* (2013.01); *F21Y 2107/00* (2016.08); *F21Y 2115/10* (2016.08)

(58) Field of Classification Search

CPC ..... F21K 9/1355; F21K 9/50; F21V 19/003; F21V 31/04; F21Y 2101/02

See application file for complete search history.

(56) References Cited

U.S. PATENT DOCUMENTS 6,190,020 B1 * 2/2001 Hartley ..... F21K 9/00 257/E25.02
6,318,887 B1 * 11/2001 Matsumoto ..... A61B 1/0669 362/574

(Continued)

FOREIGN PATENT DOCUMENTS

WO WO-2014190304 A1 11/2014
WO WO-2014190304 A9 11/2014

OTHER PUBLICATIONS

"Application Serial No. PCT/US2014/039419, International Preliminary Report on Patentability mailed Dec. 3, 2015", 8 pgs.

(Continued)

*Primary Examiner* — Tracie Y Green
(74) *Attorney, Agent, or Firm* — Schwegman Lundberg & Woessner, P.A.

(57) ABSTRACT

A light bulb includes an Edison style base, light emitting diode circuitry coupled to the base, a bulb sealed about the base and extending above the base, an elongated filament substrate supported by the base and extending into the bulb above the base, a light emitting diode channel supported by the filament substrate, coupled to the light emitting diode circuitry, and extending into the bulb above the base, and an inert gas disposed within the bulb.

20 Claims, 9 Drawing Sheets

Related U.S. Application Data filed on Mar. 7, 2014, provisional application No. 61/928,300, filed on Jan. 16, 2014, provisional application No. 61/925,109, filed on Jan. 8, 2014, provisional application No. 61/920,696, filed on Dec. 24, 2013, provisional application No. 61/915,385, filed on Dec. 12, 2013, provisional application No. 61/914,725, filed on Dec. 11, 2013, provisional application No. 61/891,289, filed on Oct. 15, 2013, provisional application No. 61/857,438, filed on Jul. 23, 2013, provisional application No. 61/842,822, filed on Jul. 3, 2013, provisional application No. 61/827,518, filed on May 24, 2013.

(51) Int. Cl.
*F21Y 115/10* (2016.01)
*F21Y 107/00* (2016.01)

(56) References Cited

U.S. PATENT DOCUMENTS 6,787,999 B2 9/2004 Stimac et al.
6,799,864 B2 10/2004 Bohler et al.
7,540,761 B2 6/2009 Weber et al.
8,596,821 B2 * 12/2013 Brandes ..... F21V 29/51 362/249.01
8,702,279 B2 * 4/2014 Oki ..... F21K 9/135 313/46
8,752,983 B2 * 6/2014 Hussell ..... F21V 29/02 362/227
9,322,543 B2 * 4/2016 Hussell ..... F21K 9/135
2006/0187652 A1 * 8/2006 Doyle ..... F21S 8/00 362/96
2009/0045715 A1 2/2009 Shantha et al.
2009/0251882 A1 10/2009 Ratcliffe
2010/0002444 A1 1/2010 Konaka
2010/0314985 A1 * 12/2010 Premysler ..... F21K 9/56 313/46
2012/0040585 A1 * 2/2012 Huang ..... F21K 9/135 445/43
2012/0217862 A1 * 8/2012 Matsuda ..... F21K 9/135 313/46
2012/0319045 A1 * 12/2012 Zhou ..... C03C 3/06 252/301.4 F
2013/0113358 A1 5/2013 Progl et al.

OTHER PUBLICATIONS

"International Application Serial No. PCT/US2014/039419, International Search Report mailed Sep. 26, 2014", 2 pgs.
"International Application Serial No. PCT/US2014/039419, Written Opinion mailed Sep. 26, 2014", 6 pgs.

* cited by examiner

LED LIGHT BULB

RELATED APPLICATIONS

This application claims priority to U.S. Provisional Application Ser. No. 61/827,518 (entitled LED MODULE, filed May 24, 2013), U.S. Provisional Application Ser. No. 61/842,822 (entitled LED MODULE, filed Jul. 3, 2013), U.S. Provisional Application Ser. No. 61/857,438 (entitled LED MODULE, filed Jul. 23, 2013), U.S. Provisional Application Ser. No. 61/891,289 (entitled LED MODULE, filed Oct. 15, 2013), U.S. Provisional Application Ser. No. 61/914,725 (entitled LED MODULE, filed Dec. 11, 2013), U.S. Provisional Application Ser. No. 61/915,385 (entitled LED MODULE, filed Dec. 12, 2013), U.S. Provisional Application Ser. No. 61/920,696 (entitled LED MODULE, filed Dec. 24, 2013), U.S. Provisional Application Ser. No. 61/925,109 (entitled LED MODULE, filed Jan. 8, 2014), U.S. Provisional Application Ser. No. 61/928,300 (entitled LED MODULE, filed Jan. 16, 2014), U.S. Provisional Application Ser. No. 61/949,878 (entitled LED MODULE, filed Mar. 7, 2014), and U.S. Provisional Application Ser. No. 61/981,307 (entitled LED MODULE, filed Apr. 18, 2014) which are incorporated herein by reference.

BACKGROUND

Light emitting diodes have long been used individually or grouped together as background or indicating lights in electronic devices. Because of the efficient light production, durability, long life, and small size, light emitting diodes were ideal for electronic applications. Light emitting diodes are increasingly prevalent in a variety of lighting functions, including flashlights and various automotive uses.

DETAILED DESCRIPTION

Figure 1:
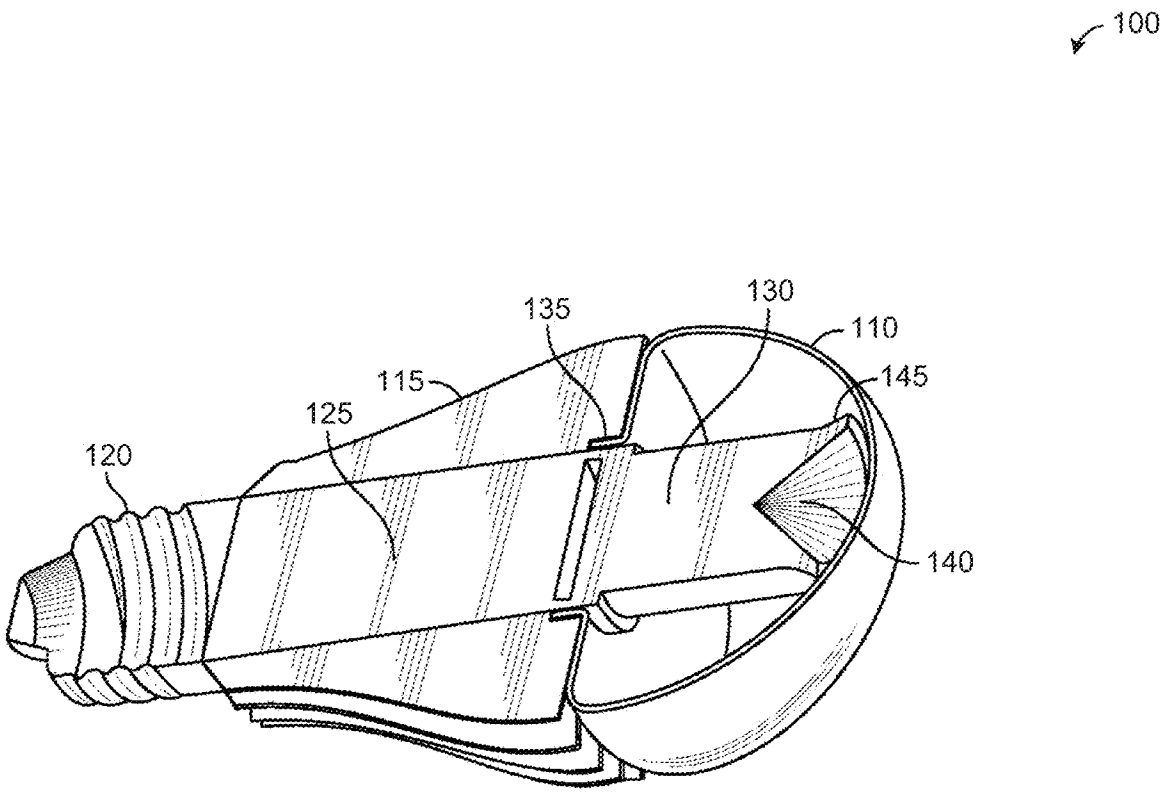
FIG. 1 is a perspective view of a cross-section of an assembled light emitting diode based light bulb according to an example embodiment.

In the following description, reference is made to the accompanying drawings that form a part hereof, and in which is shown by way of illustration specific embodiments that may be practiced. These embodiments are described in sufficient detail to enable those skilled in the art to practice the invention, and it is to be understood that other embodiments may be utilized and that structural, logical, and electrical changes may be made without departing from the scope of the present invention. The following description of example embodiments is, therefore, not to be taken in a limited sense, and the scope of the present invention is defined by the appended claims. The present application describes embodiments of light emitting diode light fixtures.

In one set of embodiments involving light emitting diodes with interchangeable components, a light emitting diode light fixture can produce a large volume of light for lighting large areas, such as parking lots, parking ramps, highways, streets, stores, warehouses, gas station canopies, and other locations. One or more light emitting diodes may be encapsulated into a substrate, such as a circuit board. The light emitting diodes may emit light of a specific color (e.g., wavelength) or specific color temperature (e.g., hue). For example, a light emitting diode may be red, green, yellowish white (2,700 K color temperature), bluish white (5,700 K color temperature), or other colors or color temperatures. In some embodiments, the substrate may be mounted on a cylindrical body portion to facilitate an electronic connection with an electronics module. The substrate and cylindrical body portion may be included within a cartridge. The cartridge may be mounted on or within a heat sink cooling structure. Some embodiments will mount the substrate at or near the end of the cartridge, where the end of the cartridge may be at or near the end of the heat sink to facilitate access to the substrate. To improve thermal diffusion, other embodiments may mount the cartridge near the center of mass of the heat sink, and use one or more lenses to focus light as described below. To improve light dispersion, one or more optical components may be mounted to surround the lens.

In one set of embodiments involving light emitting diodes with interchangeable components, the cartridges, heat sinks, lenses, or optical component may be individually replaceable. Individually replaceable components may avoid the need to replace an entire fixture. For example, if the light emitting diode or electronics within the cartridge fails, the cartridge may be replaced without requiring replacement of the lens. Additionally, the cartridges, heat sinks, lenses, or optical components may be manufactured to facilitate replacement by a user. For example, the lens may slide within the cartridge, the cartridge and lens may slide within the heat sink, and the lens may be mounted on the heat sink. The components may be mounted using a friction fit, where the friction fit enables user replacement of components, but is also secure enough to maintain the fixture structure.

In one embodiment, a lens may be used to disperse light fro one or more light emitting diode modules. The lens may be cylindrical or have a polygonal cross section The lens may be a plastic rod, a glass rod, or a cylinder of another transparent or translucent material suitable for transmission and focusing of light. The lens has a divot on one end to disperse light omnidirectionally. The divot may be a conical shaped bore, and the walls of the bore may reflect light from within the lens in a 360-degree dispersal pattern about the lens. The divot may have a pointed or rounded tip. The lens or divot may be substantially transparent, or may be coated with a translucent or colored material to soften the light emitted from the fixture. The lens and divot may be formed using injection molding, or may be formed using precision glass molding or glass grinding and polishing.

In some embodiments, the divot may have an angulated point, and may have many facets, such as a four or more to obtain a desired pattern of light reflection. In some cases, the divot may provide for reflection about a selected angle such as between 90 to 360 degrees. In further embodiments, a multifaceted divot may be used to obtain selected light patterns.

Many different types and shapes of lenses may be used. For large area high intensity lighting applications, the lens may be shaped to provide directional lighting, or a widely dispersed beam of light such that when all the modules in an array are properly oriented, a desired pattern of light is provided to light a large area, such as a parking lots, parking ramps, highways, streets, stores, warehouses, gas station canopies. Similarly, different lenses may be used for many different applications, such as for forming spotlights, narrow beams from each module may be desired.

In further embodiments, the substrate may be a simple circuit board or other suitable material for supporting light emitting diodes. The substrate may be fixed into a heat sink with adhesive or mechanical means of securing the substrate and thermally coupling it to the heat sink. Wires may be provided to couple the light emitting diodes to driver circuitry in a base such as an Edison connector. In this embodiment, the light emitting diode portion of the light fixture is not easily removable by a consumer.

In still further embodiments, the light emitting diodes may be formed in, or coupled directly into the lens, such that light is directly coupled to the lens, with a back side of the light emitting diodes positioned when assembled to conduct heat directly to a heat sink. The lens, such as in the shape of a rod at the end proximate the light emitting diodes may also be shaped to facilitate light transmission from the light emitting diodes directly into the rod without the need for further optical components.

In some embodiments, a light emitting diode module may be utilized with a desired number of light emitting diodes. The module may be mounted on a substrate with an integrated heat sink, such as a plate that may be thermally coupled to a heat sink. The light emitting diode module may also contain an integrated lens to direct light away from the light emitting diode. This module may be embedded directly into the end of the lens, which may be formed by injection molding, or cut from rod stock in various embodiments. Further methods of forming the lens may be used, as well as different methods of optically coupling the light emitting diode or light emitting diode module to the lens and to the heat sink.

Many different length rods, and rods with many different light dispersal mechanisms, may be used. The end of the rod distal to the light emitting diode module may include a dimple in some embodiments to provide light like a standard incandescent light bulb, with a center of light consistent with current standard 40, 60, and 100 watt bulbs if desired. The rod may also be shaped with a concave or convex surface to provide an emitted light dispersal pattern consistent with spot or floodlights in further embodiments. Simply utilizing a different rod for a different light dispersal pattern provides a simple, flexible way to adapt the light fixture to many different applications currently done with other types of lighting. For example, shorter rods with selected end characteristics may be used for street light or flood light applications. In some embodiments, the rods may be interchangeable, either by the consumer or during manufacture with little process change. An interchangeable rod may be replaced with a rod that provides a different light dispersion pattern. An interchangeable rod also enables a user to access other components, thereby facilitating replacement of the electronics package, the heat sink, or the optical component. Simply using the existing heat sink with ledge and electronics package provides great flexibility in solving many different lighting needs.

FIG. 1 is a perspective view of a cross-section of an assembled light emitting diode based light bulb according to an example embodiment. The assembled light bulb may include a dome 110, a heat sink 115, an Edison-style connector 120, a light emitting diode package 125, and a lens 11. The interior of the heat sink 115 may be flush with most of the light emitting diode package 125, and may include a gap 135 to mount the dome 110. A portion of the dome 110 may be configured to be inserted into the gap 135, and may be mounted to the heat sink 115 and light emitting diode package 125 using adhesive, friction fit, snap fit, or other fastening method. In one embodiment, the lens 130 may direct light away from the light emitting diode package 125 toward a divot 140, where the divot 140 disperses light about an angle of 360 degrees. In one embodiment, the lens 130 may include a flared lens end 145 to improve light dispersion. The flared lens end 145 extends outside the nominal diameter of the lens 11 in one embodiment such that light is reflected back toward the fins. The heat sink 115 may include a reflective core or reflective fins, and the divot 140 or the flared lens end 145 may direct light toward the reflective heat sink 115 to disperse light about an angle of 360 degrees. The lens 130, divot 140, and flared lens end 145 may be formed using injection molding, or may be formed using precision glass molding or glass grinding and polishing.

Figure 2:
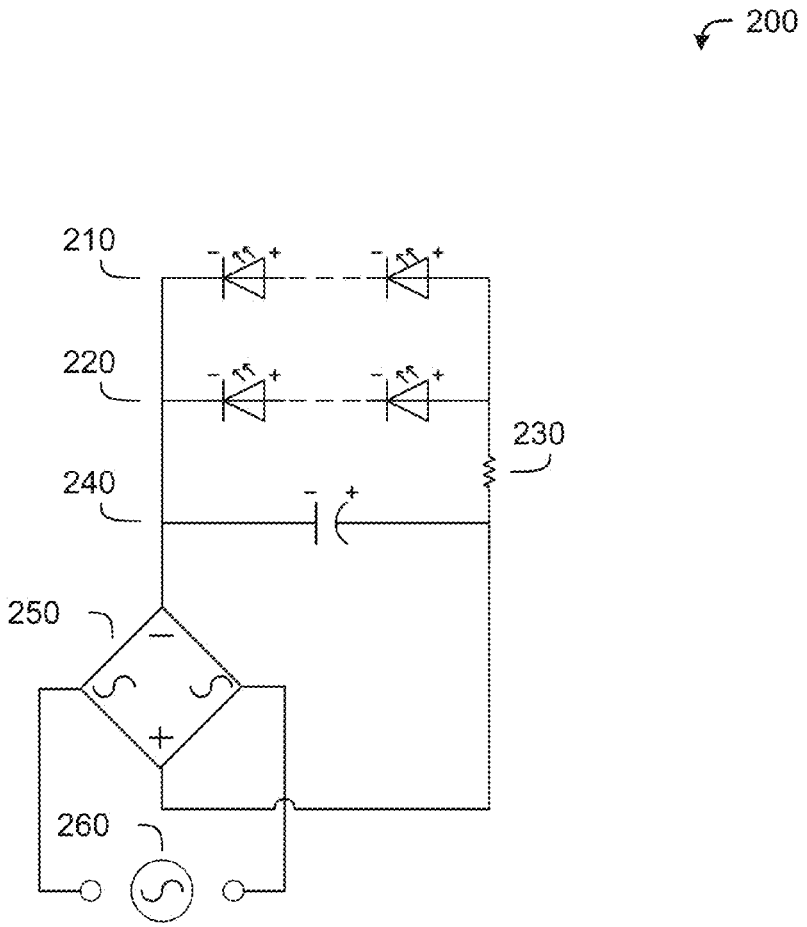
FIG. 2 is a block diagram of an AC-powered DC-rectified light emitting diode based light source with a positive-side resistor.

FIG. 2 is a block diagram of an AC-powered DC-rectified light emitting diode based light source with a positive-side resistor 200 according to an example embodiment. To reduce "flicker," first and second light emitting diode channels 210 and 220 may include power reduction resistor 230 wired in series and a capacitor 240 wired in parallel. The two similarly biased channels of light emitting diodes 210 and 220 may increase the efficiency of the light emitting diode module, such as by providing more lumens and less heat per watt. A rectifier 250 may be used to convert power supplied from an AC power supply 260 into DC power. The rectifier 250 may be selected to provide a more consistent voltage than a direct connection between the light emitting diodes 210 and 220 and the AC power supply 260. In an embodiment, the power reduction resistor 230 wired in series between the positive side of the AC power supply 260 and the first and second light emitting diode channels 210 and 220. In other embodiments, a power reduction resistor may be wired in series between the negative side of an AC power supply and a first and second light emitting diode channels, such as in FIG. 3.

Figure 3:
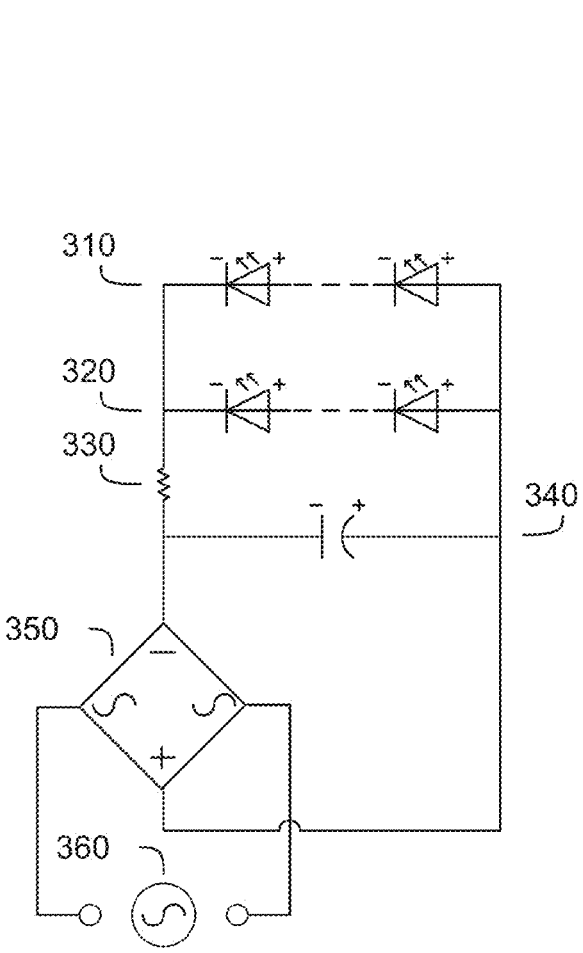
FIG. 3 is a block diagram of an AC-powered DC-rectified light emitting diode based light source with a negative-side resistor.

FIG. 3 is a block diagram of an AC-powered DC-rectified light emitting diode based light source with a negative-side resistor 300 according to an example embodiment. The a first and second light emitting diode channels 310 and 320 may include power reduction resistor 330 wired in series between the negative side of an AC power supply 360 and the first and second light emitting diode channels 310 and 320. The light source 300 may include a capacitor 340 wired in parallel with the first and second light emitting diode channels 310 and 320. A rectifier 350 may convert AC power from an AC power supply 360 into DC power. The light source 300 may be used in a single light emitting diode module embodiment, a multiple light emitting diode module embodiment, or other embodiments.

Figure 4:
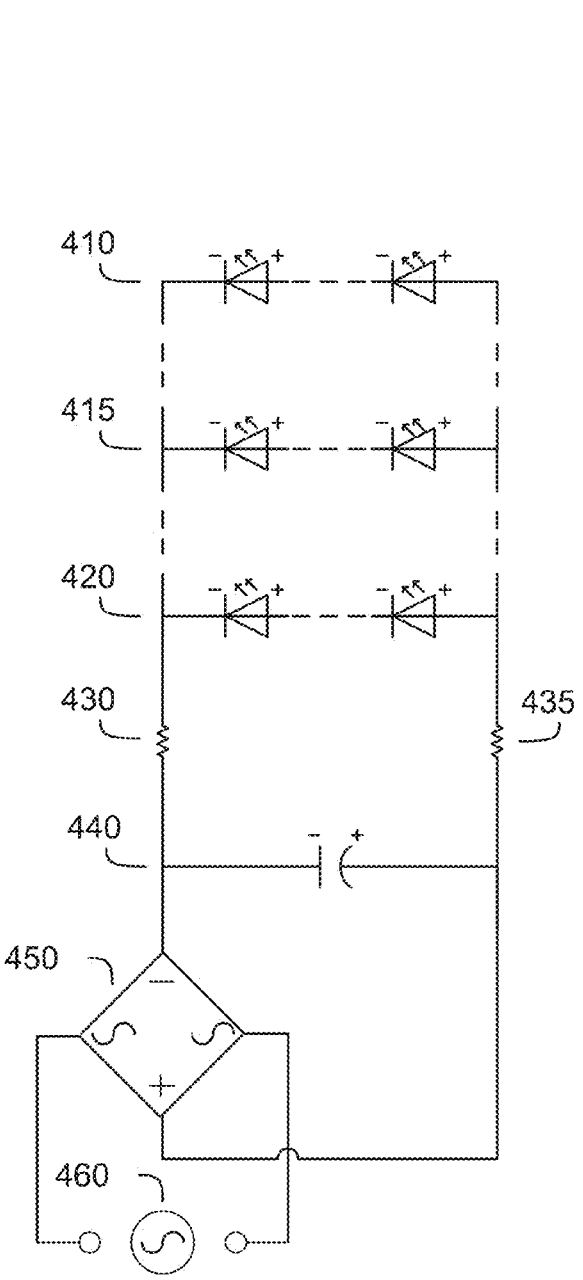
FIG. 4 is a block diagram of an AC-powered DC-rectified light emitting diode based light source with a ladder configuration of light emitting diode channels.

FIG. 4 is a block diagram of an AC-powered DC-rectified light emitting diode based light source with a ladder configuration of light emitting diode channels 400 according to an example embodiment. The lighting provided by the ladder configuration 400 may be provided by a single light emitting diode channel 410. The ladder configuration 400 may include a second light emitting diode channel 415, a third light emitting diode channel 420, or additional light emitting diode channels. Each light emitting diode channel may include a single light emitting diode, or may include multiple light emitting diodes in series. The light emitting diodes may be of varying sizes, colors, color temperatures, lumen output values, wattage ratings, or other electrical or aesthetic characteristics. The color temperature may also be changed by adding a sheath (e.g., covering) over one or more of the light emitting diode channels, where the sheath may include a colorant to alter the light emitting diode output to the desired color temperature. Each channel may have an associated control component, and the control components may receive control input from an RF radio. For example, a user could use a Wi-Fi interface to select a desired color temperature, and the channel control components may control the channels to create a desired color temperature.

The light emitting diode channels may include a first power reduction resistor 430 wired in series between the negative side of an AC power supply 460 and the light emitting diode channels, and may include a second power reduction resistor 435 wired in series between the positive side of an AC power supply 460 and the light emitting diode channels. The light source 400 may include a capacitor 440 wired in parallel with the light emitting diode channels. A rectifier 450 may convert AC power from an AC power supply 460 into DC power. The rectifier 450 may include a surge suppression component, or a surge suppression component may be wired in series with the positive or negative side of the rectifier 450. Alternatively, a surge suppression component may be wired in parallel with the neural and line side of the AC power supply 460. The rectifier 450 may include a resettable fuse or a non-resettable fuse. Alternatively, a resettable fuse or a non-resettable fuse may be wired in series with the positive or negative side of the rectifier 450, or may be wired the positive and negative side of the AC power supply 460.

Figure 5:
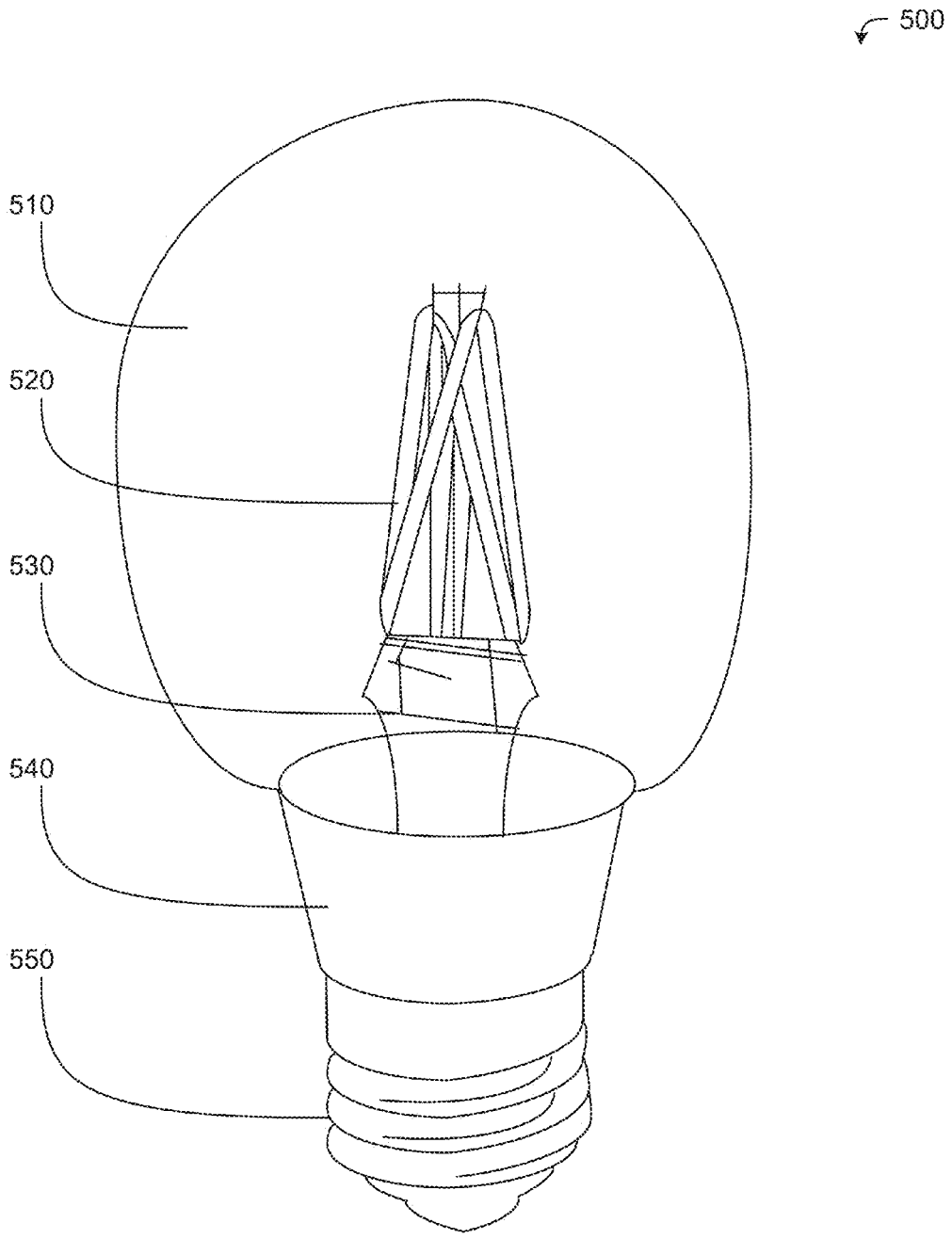
FIG. 5 is configuration of light emitting diode channels encased in a bulb.

FIG. 5 is configuration of light emitting diode channels encased in a bulb 500 according to an example embodiment. The bulb 510 may be transparent or translucent, and may be made of glass, plastic, or other transparent or translucent material. The bulb 510 may be filled with a specific gas, a combination of gasses, ambient air, or a liquid. The bulb 510 may be may be evacuated to form a vacuum. The bulb 510 may be used to dissipate or regulate the thermal temperature of one or more light emitting diode channels 520. Various electronic components 530 may be encased in and visible through the bulb 510, such as one or more of the first or second power reduction resistors 430 and 435, the capacitor 440, the rectifier 450, or other electronic components.

An enclosure 540 may be attached to the bulb 510 to dissipate or regulate the thermal temperature. A base 550 may be attached to the bulb 510. The base 550 or enclosure 540 may serve as a housing for one or more electronics, such as those shown in FIG. 4, including the first or second power reduction resistors 430 and 435, the capacitor 440, the rectifier 450, or other electronic components. For example, a radio frequency (RF) controller may be included in the base 550 or enclosure 540. In one embodiment, bulb 510 may be filled with a gas, such as Argon or any other gas or combination of gasses. The pressure within the bulb may be approximately 3 mm in some embodiments, and may vary further as desired. Argon may also serve to reduce oxidation, as well as use convection to transfer heat from the light emitting diode channels 520, from the RF controller, or from other electronics to the bulb 510 where the heat may be radiated to ambient. The heat created by the light emitting diode channels cases the gas to circulate, carrying heat away from the channels.

In one embodiment, bulb 510 with Argon or other gas may operate at 12 watts, or between 11 and 14 watts in further embodiments, and provide approximately 1600 lumens, essentially the same as a 100 watt incandescent light bulb, while maintaining a low operating temp due to the cooling properties of the gas and efficiency of the light emitting diode channels in the gas. The number of lumens may deviate from 1600 by a few tens of lumens in some embodiments, and still be referred to as approximately 1600 lumens. Since the gas displaces oxygen, less oxidation occurs to the light emitting diodes, increasing the life of the light bulb.

Each channel in one embodiment is a string of series coupled light emitting diodes coated with a protective layer. Coloring may be added to the protective layer and the layer may be heated to solidify it. The layer may be formed of the same material currently used to protect light emitting diodes.

One or more electronic components or the driver may be disposed on a transparent substrate to improve light dispersion. The transparent substrate may be made from glass, or it may be comprised of any other transparent material. The transparent substrate material may have a low thermal conductivity so as not to absorb heat, such as heat generated within a light bulb. One or more electrical contacts, rectifiers, surge fuses, integrated circuits, or other electronic components may be affixed to the transparent substrate. The transparent substrate may be circular, cylindrical, or formed in any other shape. The transparent substrate may be arranged anywhere in the bulb. For example, the transparent substrate and driver may be formed like a doughnut, and may be arranged around a central bulb internal stem or in the base of a bulb. By arranging the transparent substrate within the bulb, any heat generated by the transparent substrate may use the convective properties of the gas (e.g., heat diffusion and advection) within the bulb to stabilize the operating temperature of the electronic components or the driver that are disposed on the transparent substrate. The transparent substrate may be visible within the bulb, or may be located in the enclosure 540 or within the base 550. In further embodiments, the substrate for mounting components may be any other suitable transparent material to minimize heat absorption from the light emitting diode light, or may be formed of a metal such as aluminum or copper for example with good heat conducting properties. An RF controller may be arranged on the transparent substrate and driver, or a separate RF controller may be included in the enclosure 540 or within the base 550. The RF controller may be separated physically from the transparent substrate and driver to allow heat generated by the RF controller to use the convective properties of the gas to stabilize the RF controller operating temperature.

In some embodiments, the light emitting diode channels 520 may be referred to as filaments. These filaments in one embodiment may be formed on a filament substrate such as a strip of aluminum, glass, or another material which may be transparent and have sufficient width, length, and mechanical strength to support a similar length strip of light emitting diodes. In further embodiments, the filament substrate may be formed of ceramic material that provides structural support for the light emitting diodes.

Figures 6A, 6B, 6C:
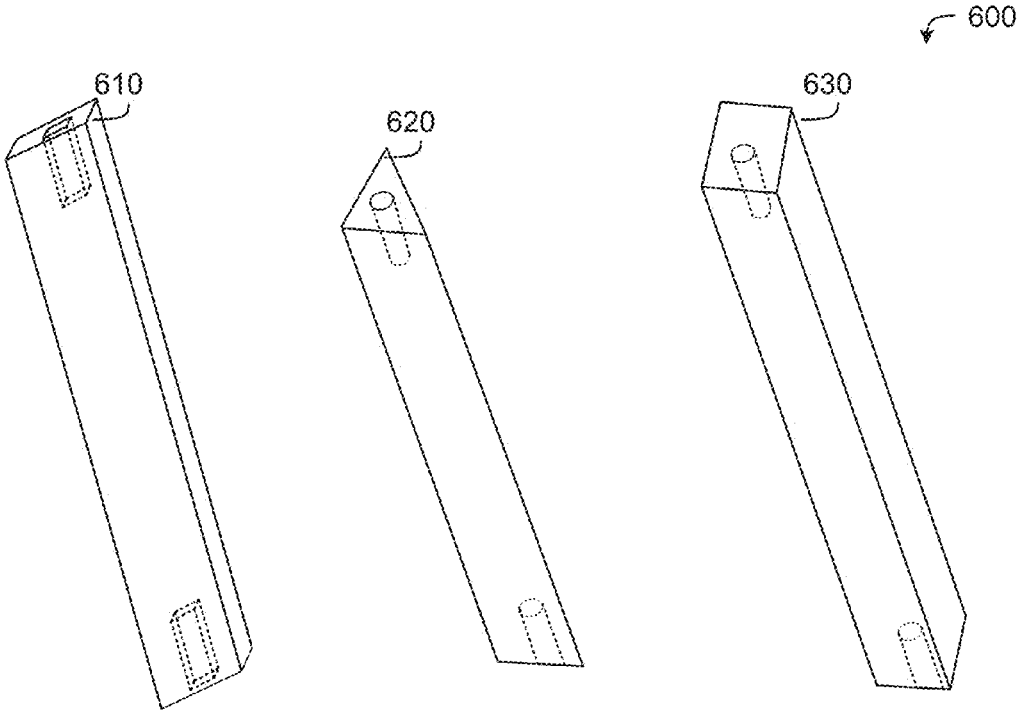
FIGS. 6A, 6B, 6C, 6D, 6E, and 6F are block perspective views of multiple sided filaments to support light emitting diode strips according to example embodiments.
Figures 6D, 6E, 6F:
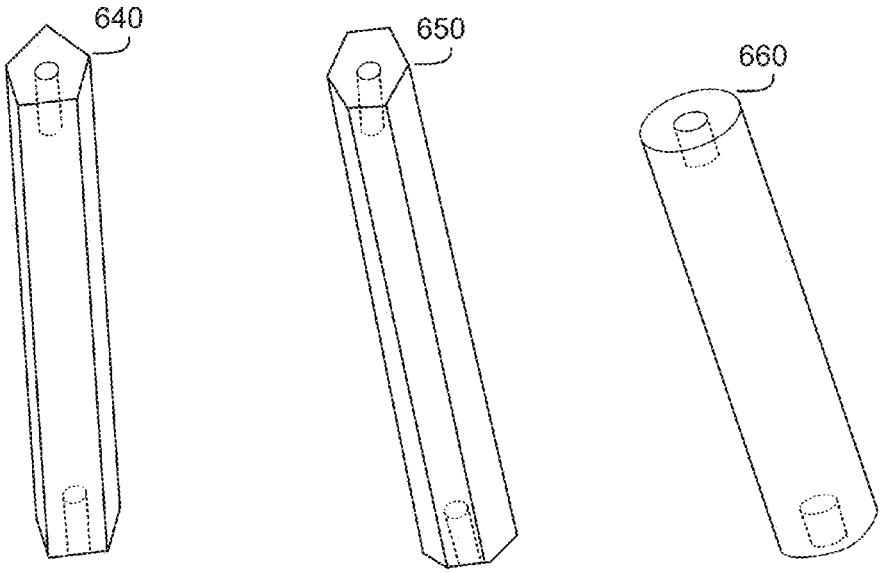

FIG. 6A is a perspective block diagram view of a two sided ceramic filament substrate 600. The filament substrate 600 may support a light emitting diode channel in the form of a light emitting diode strip on a side 610, and a further light emitting diode strip on a side opposite side 610. The light emitting diode strips may be coupled to the filament substrate via adhesive, weld, or other suitable method capable of retaining the strips in position during operation. The ceramic material of the filament substrate insulates the light emitting diode strips from each other.

In one embodiment, the filament substrate is elongated and extends from the base 550 containing electronics up into the bulb 510 a distance compatible with the size of the bulb, such as ½ to 1 inches for small bulbs and 2-3 inches or longer for larger bulbs. In one embodiment, the length of the filament substrate and corresponding one or more light emitting diode strips, which may also be correspondingly elongated and shaped to fit on a side of the elongated filament substrate, is a function of the wattage/lumens of the bulb, with longer lengths utilized for higher lumen bulbs, such as 1600 lumens, corresponding to a 100 watt incandescent bulb. The filament substrate along with strips of light emitting diodes may be positioned near the middle of the bulb, elevated from the base, to provide for better light distribution. The elevation may be accomplished by utilizing filament substrates of suitable length to provide the desired elevation, or the filament substrates may be mounted on a material, such as glass extending from the base to a point at which the beginning of the filament and light generation from the light emitting diode strip is desired.

Further embodiments of filaments are illustrated in FIG. 6B showing a three sided filament 620, 6C illustrating a four sided filament 630, 6D illustrating a five sided filament 640, 6 E illustrating a six sided filament 650, and 6F illustrating a cylindrical filament 660. Light emitting diode strips may be supported on one or more sides of such filaments, and in the case of the cylindrical filament, any number of strips that will be supportable by the filament may be used.

As described above, the bulb may also be filled with a gas to provide heat transport away from the light emitting diode strips and filament substrates. An example gas may be an inert or noble gas, any other gas, or any combination of gasses. An example of a noble gas may be helium, argon, or any other combination of noble gasses. Some sides of the filaments may also be left exposed to the gas to provide for additional heat transfer, yet still provide adequate light distribution.

Figure 7:
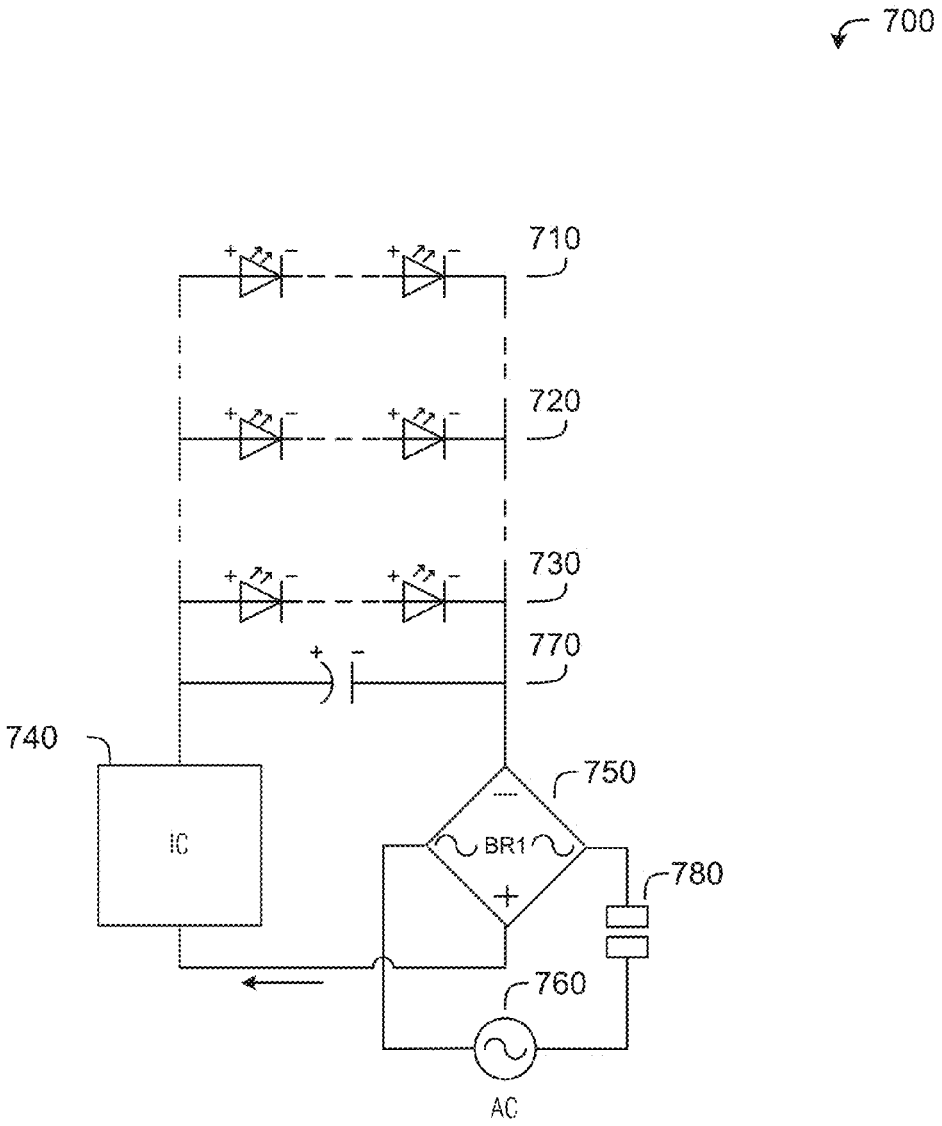
FIG. 7 is a block diagram of an IC-controlled light emitting diode based light source with a ladder configuration of light emitting diode channels.

FIG. 7 is a block diagram of an IC-controlled light emitting diode based light source with a ladder configuration of light emitting diode channels 700. The lighting provided by the ladder configuration 700 may be provided by a single light emitting diode channel 710. The ladder configuration 700 may include a second light emitting diode channel 720, a third light emitting diode channel 730, or additional light emitting diode channels. Each light emitting diode channel may include a single light emitting diode, or may include multiple light emitting diodes in series. The light emitting diodes may be of varying sizes, colors, color temperatures, lumen output values, wattage ratings, or other electrical or aesthetic characteristics.

The light emitting diodes may use various materials to generate or reflect light. Various conductive materials may be used, including copper, aluminum, or other conductive materials. Light from the light emitting diodes may be reflected in a hemispherical direction by placing the light emitting diode on a reflective surface. This reflective surface may also be used to support the light emitting diode and associated circuitry. Alternatively, a light emitting diode may be arranged on a surface that is translucent or transparent. The light emitting diode surface may be manufactured in various physical configurations, including flat, round, two-sided flat, or multi-sided. The light emitting diode surface may be manufactured using various materials, such as any natural material (e.g., quartz) or synthetic material (e.g., glass, ceramic, clear polymer). The material for the light emitting diode surface may be selected based on the transmittance (e.g., amount of light that passes through), may be selected for its ability to withstand the heat generated by the light emitting diodes, may be selected for financial or other reasons. A thermally conductive gas may be selected for use with a particular light emitting diode and surface. For example, the ladder configuration 700 may be encased in a transparent container (e.g., a bulb) with a pure gas (e.g., helium, argon, or any other gas) or combination of gasses, where the gas or gasses may be used to reduce or transfer heat generated by the light emitting diode. Various inert gases or combinations of inert gases may be used in one embodiment. The type of gas used may vary depending on the type of LED used and its compatibility with the gas.

The light emitting diode channels may include an integrated circuit 740 wired in series between the positive side of a DC rectifier 750 and the light emitting diode channels. FIG. 7 depicts a single integrated circuit 740 and a single DC rectifier 750, though additional integrated circuits and additional rectifiers may be used. The integrated circuit 440 may be used to control the power applied to the light emitting diode channels by controlling current or voltage. The rectifier 750 may convert AC power from an AC power supply 760 into DC power. The rectifier 750 or integrated circuit 740 may include a surge suppression component 780, or a surge suppression component may be wired in series with the positive or negative side of the rectifier 750. Alternatively, a surge suppression component may be wired in parallel with the neural and line side of the AC power supply 760. The rectifier 750 integrated circuit 740 may include a resettable fuse or a non-resettable fuse. Alternatively, a resettable fuse or a non-resettable fuse may be wired in series with the positive or negative side of the rectifier 750, or may be wired the positive and negative side of the AC power supply 760.

In a further embodiment, an optional capacitor 770 may be coupled in parallel with the light emitting diodes to smooth the waveform presented to the light emitting diodes. The size of the capacitor may be selected to increase efficiency of the light emitting diodes and/or to reduce flicker. Resistors may also be provided to aid in smoothing the waveform as illustrated in FIGS. 2, 3, and 4.

Figure 8:
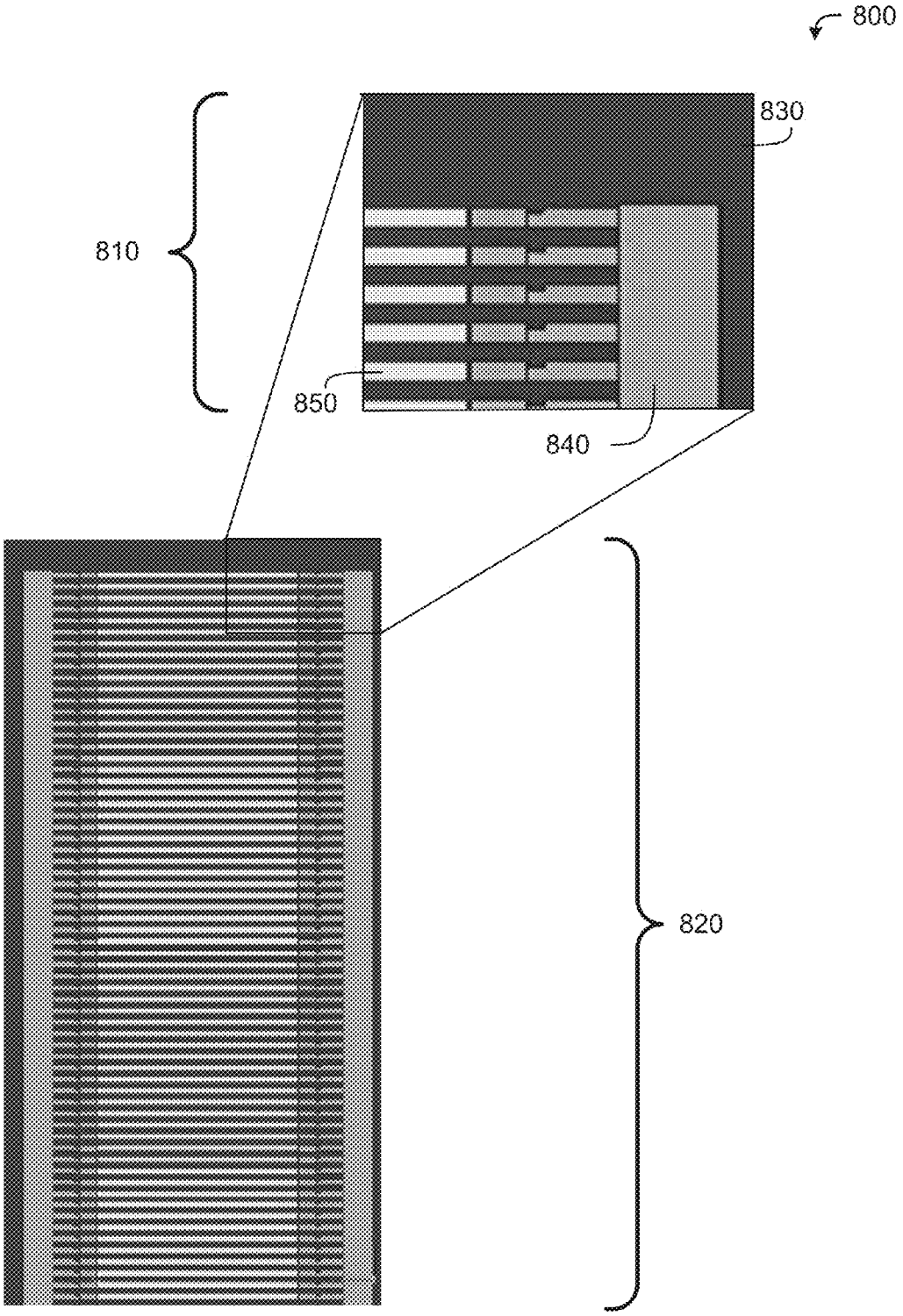
FIG. 8 is a diagram of a manufacturing template for manufacturing glass substrates for transparent filaments according to an example embodiment.

FIG. 8 is a diagram of a manufacturing template 800 for manufacturing glass substrates for transparent filaments according to an example embodiment. As shown in FIG. 8, a subset 810 of the larger template 820 has been enlarged to show detail. The manufacturing template 800 may include a support frame 830, an electric contact array 840, and a transparent filament array 850. Each strip of glass shown in the transparent filament array 850 is a filament substrate upon which one or more channels of light emitting diodes may be secured. The support frame 830 may support the electric contact array 840 and transparent filament array 850, and may be cut away during manufacturing to reveal the individual glass filaments.

Various materials may be used in the manufacturing template 800. The support frame 830 may be comprised of glass, a PCB substrate, or other material. The electric contact array 840 may be formed from an electrically conductive material deposited on the support frame 830, where the material may be formed from aluminum, copper, or one or more other conductive materials. The electric contact array 840 may be arranged to be in contact with the transparent filament array 850. The transparent filament array 850 may be disposed within the support frame 830, or may be formed from the same transparent material, such as glass or another transparent material. For example, the support frame 830 and transparent filament array 850 may be formed from a single sheet of glass, the electric contact array 840 may be formed on the sheet of glass, and the transparent filament array 850 may be separated into individual glass filaments.

The following figure has the same numbering as FIG. 8, and shows the transparent filament array 850 with the support frame 830 removed. The array 850 has been cut into separate filaments at this point via laser and/or by other methods of cutting. The light emitting diodes may be affixed to one or both sides of each filament in various patterns, such as one or more channels and electrically coupled to the contacts on the ends of the filaments 850.

Figure 9A:
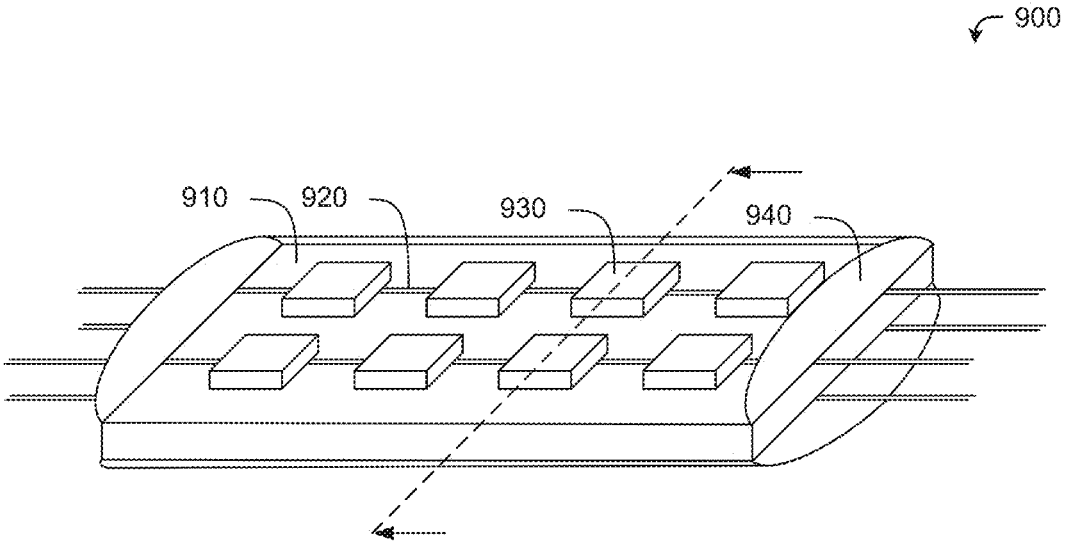
FIGS. 9A and 9B are a perspective diagrams for a manufactured glass filament according to an example embodiment.
Figure 9B:
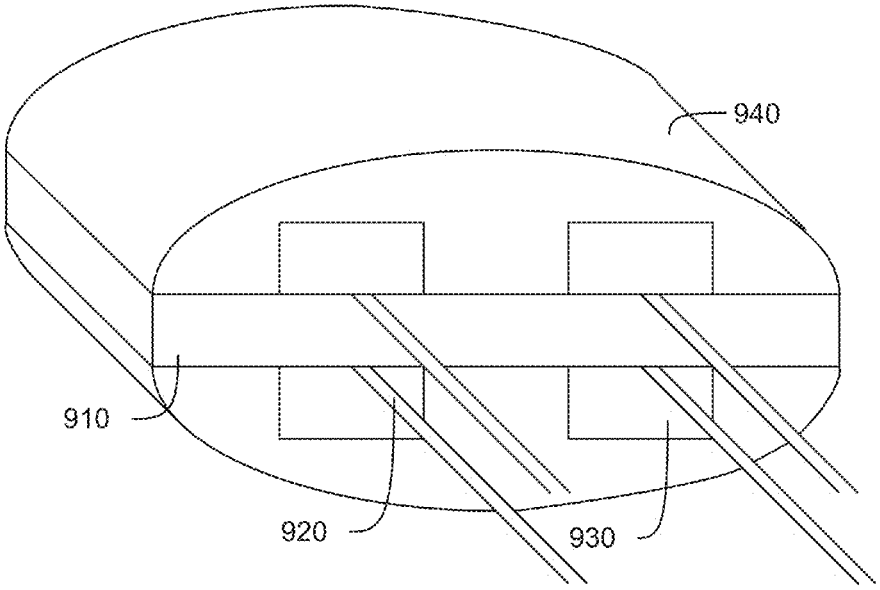

FIGS. 9A and 9B are a perspective diagrams for a manufactured glass filament 900 according to an example embodiment. The manufactured glass filament 900 may include a glass substrate 910, one or more conductive lines 920, one or more light emitting diodes 930, and a coating 940. FIG. 9A shows a perspective view of a manufactured glass filament 900 with the coating 940 cut away, whereas FIG. 9B shows the cross-section of FIG. 9A with coating 940. The light emitting diodes 930 may be arranged on the glass substrate 910 to form one or more light emitting diode channels, such as shown in FIG. 7. As shown in FIGS. 9A and 9B, two parallel channels of light emitting diodes 930 may be connected using conductive lines 920. In various embodiments, the glass substrate 910 may be wide enough to include one, two, three, or more light emitting diode channels arranged in series, parallel, or in a combination of series and parallel configurations. Within each channel, the light emitting diodes may be connected using conductive lines 920 in series, parallel, or in a combination of series and parallel configurations. Each channel of light emitting diodes may be electrically connected to positive and negative terminals of a power source through a contact provided by the conductive lines 920. For example, two individual glass filaments may be used to form a single channel of light emitting diodes, where the two individual glass filaments may be arranged in an inverted "V" shape, and power may flow from a positive terminal up through one filament and down through the other filament to a negative terminal.

The manufactured glass filament 900 may be of varying sizes, colors, color temperatures, lumen output values, wattage ratings, or other electrical or aesthetic characteristics. Various characteristics may be selected by altering the chemical composition of the glass substrate 910 or the coating 940. For example, the color temperature may be changed by adding a coloring compound to the coating 940 and drying the coating 940 in the shape shown in FIG. 9B. The manufactured glass filament 900 may enable a light source to produce light with a reduced wattage through improved efficiency in heat diffusion and light dispersion. For example, the use of an elongated filament enables improved heat dissipation by conducting heat away from light emitting diodes to a gas, such as helium, argon, any other gas, or any combination of gasses, which may use convection to cool the light emitting diodes. The use of a transparent material for the glass substrates 910 or coating 940 enables improved light dispersion, allowing light generated by the light emitting diodes to pass through the glass substrate 910 and coating 940 in various directions.

In various embodiments, light emitting diodes 930 may be placed on only one side of the glass substrate 910, or on both sides. If placed on both sides, the diodes on each side may be staggered from each other, either along the length of the glass substrate, or the width of the glass substrate, such that light from a diode on a first side of the substrate may be projected away from the substrate and through the substrate, with the light projected through the substrate not being significantly blocked by a diode placed on the second side of the substrate. Further, the light from a diode on the second side of the substrate and projected through the substrate may not be significantly blocked by a diode placed on the first side of the substrate. Many different forms of staggering opposing sets of diodes forming channels on each side may be used to optimize overall light transmission through and away from the substrate.

In further embodiments, the filament may be made of a transparent material such as glass or sapphire. Synthetic sapphire may be industrially produced from agglomerated aluminum oxide, sintered and fused in an inert atmosphere (hot isostatic pressing for example), yielding a transparent polycrystalline product, slightly porous, or with more traditional methods such as Verneuil, Czochralski, flux method, etc., yielding a single crystal sapphire material which is non-porous and should be relieved of its internal stress. Fixing the light emitting diodes to a transparent filament results in a chip on glass filament or COG.

One application of synthetic sapphire is sapphire glass. Sapphire is highly transparent to wavelengths of light between 150 nm (UV) and 5500 nm (IR). Sapphire glass may be made from pure sapphire boules that have been grown in an application specific crystal orientation, typically along the optical axis, the c-axis for minimum birefringence. The boules may be sliced up into the desired window thickness and finally polished to the desired surface finish. Sapphire optical sheets may be polished to a wide range of surface finishes due to its crystal structure and its hardness. The sheets may then be cut in strips for use as a filament to support light emitting diode chips.

Sapphire glass may have exceptional hardness and toughness makes it very resistant to scratching. Sapphire has a wide-band transparency and thermal conductivity, allowing it to handle very high power densities in the infra-red or UV spectrum without degrading due to heating, such as heating by light emitting diodes mounted to a sapphire filament. Artificial sapphire has been used for integrated circuits because it has a quite low conductivity for electricity, but a much-higher conductivity for heat. Thus, sapphire provides good electrical insulation, while at the same time doing a good job at helping to conduct away the significant heat that is generated in all operating integrated circuits.

In one embodiment, the filament may be porous, provide better heat transfer, via both conduction and convection, away from light emitting diodes mounted on the filament. In the case of a transparent glass filament, several commercially available porous glass materials may be used, including Vycor® brand porous glass 7930. 7930 is an open-cell porous glass which exhibits excellent heat transfer properties. It has a void space of about 28% of its volume with an internal surface area of 250 $M^2$1 gram, with an average pore diameter of 4OA or 4 millimicrons. Such porous glass may have pores in the nm to mm range and may commonly be prepared using different processes such as through metastable phase separation in borosilicate glasses followed by liquid extraction of one of the formed phrases, or simply by sintering glass powder. While the porous filament may be transparent in some embodiments, it need not be transparent in other embodiments.

Many different pore sizes may be utilized, provided structural integrity is maintained for supporting light emitting diodes in various configuration in a manner that that the light emitting diodes do not decompose or otherwise have impaired structural support when the pores are too large to adequately support the light emitting diodes such as via adhesive or other fastening mechanism which may be used to hold the light emitting diodes in contact with the filament. The width of such a filament may be 1 to 2 or 3, or higher mm. In some embodiments, the filament may be ½ to 1 mm thick and several mm long. Other thicknesses may also be utilized subject to the filament providing a tradeoff between adequate support, integrity, and heat transfer capabilities. The width and length of the filament may be varied to support a desired number of light emitting diodes sufficient to provide a desired number of lumens, such as up to 1600 lumens corresponding to a 100 watt incandescent bulb or higher for a higher lumen bulb. Lower lumen bulbs may utilize shorter lengths or narrower widths in further embodiments.

Elements from the embodiments and examples below may be put together in different combinations in further embodiments.

EXAMPLES

1. A light comprising:

a heat sink;

a light emitting diode module thermally coupled to the heat sink;

a lens optically coupled to the light emitting diode to disperse light about a divot formed in the lens.

2. The light of example 1 wherein the heat sink includes a depression adapted to hold the substrate in a bottom of the depression and support the lens about a wall of the depression.

3. The light of example 2 wherein the depression extends a sufficient distance into the heat sink to provide support for the lens.

4. The light of example 2 wherein the lens is adhered by a sealant between the lens and the wall of the depression.

5. The light of example 4 wherein the lens and depression are cylindrical in shape.

6. The light of any of examples 1-5 wherein the light emitting diode module is embedded in an end of the lens.

7. The light of any of examples 1-6 wherein the light emitting diode module includes an internal heat sink that is thermally coupled to the heat sink.

8. The light of any of examples 1-7 wherein the heat sink includes a vapor transport heat sink.

Further Examples

9. A light emitting diode module, the module comprising:

a heat sink with a plurality of fins;

a substrate thermally coupled to the heat sink;

a plurality of light emitting diodes electrically coupled to the substrate and configured to produce light;

an optical component coupled to the light emitting diodes to direct light away from the substrate;

a lens optically coupled to the optical component to disperse light omnidirectionally about a divot formed in the lens.

10. The light emitting diode module of example 9 wherein the heat sink includes a depression adapted to hold the substrate in a bottom of the depression and support the lens about a wall of the depression.

11. The light emitting diode module of example 10 wherein the depression extends a sufficient distance into the heat sink to provide support for the lens.

12. The light emitting diode module of example 10 or 11 wherein the lens is adhered by a sealant between the lens and the wall of the depression.

13. The light emitting diode module of example 12 wherein the lens and depression are cylindrical in shape.

14. The light emitting diode module of any of examples 9-13 and further comprising an optical gel coupled between the optical element and the lens to facilitate transfer of light from the optical element into the lens at a first end of the lens for optical dispersion about the divot formed in a second end of the lens.

15. The light emitting diode of any of examples 9-14 wherein the lens comprises a plastic rod.

16. The light emitting diode of example 15 wherein the divot comprises a conical shaped bore in an end of the rod such that a wall of the bore reflect light from in the rod in a 360 degree dispersal about the rod.

17. The light emitting diode of example 16 wherein the wall of the bore is colored to soften the light.

18. The light emitting diode of example 16 wherein the lens is translucent and tinted with a selected color.

19. The light emitting diode module of any of examples 9-18 wherein the optical component includes substantially conical elements to focus light away from each light emitting diode.

20. A light comprising:

a heat sink having a plurality of fins extending laterally from a core;

a substrate thermally coupled to the heat sink core;

a light emitting diode electrically coupled to the substrate and configured to produce light;

an optical component coupled to the light emitting diodes to direct light away from the substrate;

a lens optically coupled to the optical component to disperse light omnidirectionally about a divot formed in the lens; and a base coupled to the heat sink, the base including an Edison connector for mating with a light socket and electronics for driving the light emitting diode.

21. The light of example 20 wherein the base is removeably coupled to the heat sink and light emitting diode to facilitate replacement of the base.

Still Further Examples

22. A light comprising:

a central tube having heat sink fins coupled to the tube;

a light emitting diode package thermally coupled within the central tube and located a selected distance from a first end of the tube;

an electronics module coupled to a second end of the tube and electrically connected through the tube to the light emitting diode package;

an Edison connector coupled to the electronics module; and a lens optically coupled to the light emitting diode package, wherein the lens extends through the tube from an end proximate the light emitting diode package to beyond the first end of the tube to disperse light in a selected pattern.

23. The light of example 22 wherein a portion of the inside of the central tube between the light emitting diode package and the first end of the tube is reflective to light generated by the light emitting diode package.

24. The light of any of examples 22-23 wherein at least a portion of the fins are reflective to light generated by the light emitting diode package.

25. The light of any of examples 22-24 and further comprising a collar positioned around a portion of the lens extending beyond the first end of the tube, wherein an inside portion of the collar is reflective to light generated by the light emitting diode.

26. The light of any of examples 22-25 wherein the lens comprises a short rod of transparent material having a flat top extending above the collar to project light outward from the light emitting diode package.

27. The light of any of examples 22-26 wherein the lens and tube are cylindrical in shape.

28. The light of any of examples 22-27 wherein the tube further comprises slots formed on an outside of the tube to support the fins via a crimp fit.

29. The light of any of examples 22-28 wherein the light emitting diode package includes an internal heat sink that is thermally coupled to the central tube and heat sink fins.

30. The light of any of examples 22-39 wherein the lens includes a divot formed on an end opposite the end proximate the light emitting diode package.

31. The light of any of examples 22-30 wherein the lens includes a tapered edge formed at an end opposite the end proximate the light emitting diode package.

32. A light emitting diode module, the module comprising:

a heat sink having a plurality of fins;

a substrate thermally coupled to the heat sink;

a plurality of light emitting diodes electrically coupled to the substrate and configured to produce light;

a lens optically coupled to the light emitting diodes to disperse light omnidirectionally about a divot formed in the lens.

33. The light emitting diode module of any of examples 22-32 wherein the heat sink includes a depression, the depression adapted to hold the substrate in a bottom of the depression and support the lens about a reflective wall of the depression.

34. The light emitting diode module of any of examples 22-33 wherein the depression extends a sufficient distance into the heat sink to provide support for the lens.

35. The light emitting diode module of any of examples 22-34 wherein the lens and depression are cylindrical in shape.

36. The light emitting diode of any of examples 32-35 wherein the lens comprises a plastic rod.

37. The light emitting diode of any of examples 32-36 wherein the divot comprises a conical shaped bore in an end of the rod such that a wall of the bore reflect light from in the rod in a 360 degree dispersal about the rod.

38. The light emitting diode of any of examples 32-37 wherein the fins have reflective sides to disperse light generated by the light emitting diodes.

39. A light comprising:

a heat sink having a plurality of fins extending laterally from a core;

a substrate thermally coupled to the heat sink core;

a light emitting diode electrically coupled to the substrate and configured to produce light;

a lens optically coupled to the light emitting diode to disperse light generated by the light emitting diode outside of the heat sink core; and a base coupled to the heat sink, the base including an Edison connector for mating with a light socket and electronics for driving the light emitting diode.

40. The light of example 39 wherein the fins are reflective.

41. The light of any of examples 39-40 wherein an inside of the heat sink core is reflective.

42. The light of any of examples 39-41 wherein a top of the base is reflective.

43. The light of any of examples 39-40 and further comprising a dome covering the lens to soften light dispersed by the lens.

44. The light of any of examples 39-43 wherein the dome includes a first portion and a second portion, wherein the first portion extends from the plurality of fins and is cylindrical, and wherein the second portion extends from the first portion and ends in an arcuate dome shape.

45. The light of any of examples 39-44 wherein the dome is optically coupled to the lens.

46. The light of any of examples 39-45 wherein the dome is fixedly attached to at least two of the plurality of fins.

47. The light of any of examples 39-46 wherein the dome includes a hole to drain water on the end opposite the lens.

48. The light of any of examples 39-47 wherein the fins are transparent.

49. The light of any of examples 39-48 wherein the heat sink core is transparent.

50. The light of any of examples 39-49 wherein the heat sink core is reflective, and wherein the diameter of the heat sink core proximal to the base is greater than the diameter of the heat sink core distal to the base.

51. The light of any of examples 39-50 wherein the fins include rounded edges.

52. The light of any of examples 39-51 wherein the heat sink includes thermally conductive glass.

53. The light of any of examples 39-52 wherein the heat sink and the plurality of fins are formed from a single body.

54. The light of any of examples 39-53 wherein the plurality of fins are fixedly attached to the heat sink core.

55. The light of any of examples 39-54 wherein the reflective fins are formed from a reflective material.

56. The light of any of examples 39-55 wherein the reflective fins are coated with a reflective material.

57. A light emitting diode module comprising: a first channel of series connected light emitting diodes to couple to an AC source; a second channel of series connected light emitting diodes to couple to the AC source, wherein the first and second channels are coupled oppositely biased to the AC source such that the channels alternately provide light corresponding to positive and negative cycles of the AC source, wherein the first and second channels each include a same number of light emitting diodes, and wherein the number of light emitting diodes in each channel reduces the peak voltage of the AC source such that all light emitting diodes are operating at voltages within their design parameters.

58. The light emitting diode module of example 57 wherein the AC source comprises standard household electricity.

59. The light emitting diode module of any of examples 57-59 wherein the light emitting diodes are mounted on a substrate sized to fit within a light bulb.

60. The light emitting diode module of any of examples 59-60 wherein the light emitting diodes form an array on the substrate.

61. The light emitting diode module of any of examples 60-61 wherein the light emitting diodes from each channel are physically intermixed in the array to minimize perception of flicker.

62. The light emitting diode module of any of examples 57-62 wherein the first channel comprises light emitting diodes having a first color, and wherein the second channel comprises light emitting diodes having a second color different than the first color.

63. The light emitting diode module of any of examples 57-63 wherein the channels are coupled to the AC source without the use of a driver circuit.

64. A light emitting diode module comprising: a first channel of series connected light emitting diodes to couple to an AC source; a second channel of series connected light emitting diodes to couple to the AC source, wherein the first and second channels are coupled oppositely biased to the AC source.

65. The light emitting diode module of example 64 and further comprising a surge protecting diode coupled across the AC source.

66. The light emitting diode module of any of examples 65-66 and further comprising a capacitor coupled in parallel with each channel of light emitting diodes.

67. The light emitting diode module of any of examples 64-67 and further comprising a capacitor coupled in parallel with each channel of light emitting diodes.

68. The light emitting diode module of any of examples 66-68 wherein each string comprises a diode coupled between the light emitting diodes and the AC source.

69. The light emitting diode module of any of examples 64-69 wherein each string comprises a diode coupled between the light emitting diodes and the AC source.

70. A method comprising: connecting a first channel of multiple light emitting diodes to an AC source such that the first channel provides light during each positive cycle of the AC source; and connecting a second channel of multiple light emitting diodes to the AC source such that the second channel provides light during each negative cycle of the AC source.

71. The method of example 70, further comprising: connecting the first channel and the second channel in parallel to form a channel pair; connecting a first resistor between the AC source and a first end of the channel pair; and connecting a second resistor between the AC source and a second end of the channel pair.

72. A method comprising: connecting a series of pairs of light emitting diodes to an AC source, wherein each pair of light emitting diodes includes a first diode in a first direction and a second diode in a second direction, wherein the first direction is opposite from the first direction, wherein the first diode provides light during each positive cycle of the AC source; and wherein the second diode provides light during each negative cycle of the AC source.

73. The method of example 72, further comprising: connecting a first resistor between the AC source and a first end of the series of pairs of light emitting diodes; and connecting a second resistor between the AC source and a second end of the series of pairs of light emitting diodes.

74. The method of example 72, further comprising: connecting a first and second Zener diodes in parallel with the AC source and the series of pairs of light emitting diodes; wherein the first and second Zener diodes are arranged in opposite directions to provide an AC voltage clamp.

75. The method of example 72, further comprising arranging the series of pairs of light emitting diodes within a dome-shaped light diffuser to reduce flicker.

76. The method of example 72, further comprising arranging the series of pairs of light emitting diodes within a housing, wherein the housing includes an Edison-style connector, and wherein the housing can be used in a standard light bulb socket.

77. A light bulb comprising a light emitting diode module having multiple light emitting diodes, a central tube adapted to support the light emitting diode module about a first end of the central tube, multiple heat sink fins radially extending from and supported by the central tube, multiple openings in the central tube positioned to convect heat from the light emitting diode module between the heat sink fins; and a connector disposed about a second end of the central tube and electrically coupled to the light emitting diode module.

78. The light bulb of example 77 wherein the openings comprise elongated slots positioned between the heat sink fins.

79. The light bulb of example 77 wherein the openings comprise multiple openings alternately staggered at different depths of the central tube from the light emitting diode module.

80. The light bulb of example 77 and further comprising a dome shaped light diffuser coupled to the first end of the central tube.

81. The light bulb of example 77 wherein the light emitting diode module is positioned within the tube such that a portion of the tube extends above the light emitting diode module.

82. A light bulb comprising a light emitting diode module having multiple light emitting diodes, a central tube adapted to support the light emitting diode module about a first end of the central tube, multiple openings in the central tube positioned to convect heat from the light emitting diode module outside of the central tube; and a connector disposed about a second end of the central tube and electrically coupled to the light emitting diode module.

83. The light bulb of example 82 wherein the openings comprise elongated slots.

84. The light bulb of example 82 wherein the openings comprise multiple openings alternately staggered at different depths of the central tube from the light emitting diode module.

85. The light bulb of example 82 and further comprising a dome shaped light diffuser coupled to the first end of the central tube.

86. The light bulb of example 82 wherein the light emitting diode module is positioned within the tube such that a portion of the tube extends above the light emitting diode module.

87. A light emitting diode module comprising a first light emitting diode channel including one or more first light emitting diodes, a first resistor electrically connected in series with the first light emitting diode channel, a capacitor electrically connected in parallel with the first light emitting diode channel, and a rectifier electrically connected in series with the first light emitting diode channel to provide a DC voltage from an AC power source to the first light emitting diode channel.

88. The light emitting diode module of example 87, further comprising a second light emitting diode channel including one or more second light emitting diodes electrically connected in parallel with the first light emitting diode channel, wherein the parallel wired first and second light emitting diode channels increase the efficiency of the light emitting diode module.

89, The light emitting diode module of example 87, wherein the first resistor is electrically connected in series between the first light emitting diode channel and the positive side of the AC power source.

90, The light emitting diode module of example 87, wherein the first resistor is electrically connected in series between the first light emitting diode channel and the negative side of the AC power source.

91. The light emitting diode module of example 87, further including a second resistor electrically connected in series between the first light emitting diode channel and the negative side of the AC power source, and wherein the first resistor is electrically connected in series between the first light emitting diode channel and the positive side of the AC power source.

92. A light bulb comprising an Edison style base, light emitting diode circuitry coupled to the base, a bulb sealed about the base and extending above the base, a light emitting diode channel coupled to the light emitting diode circuitry and extending into the bulb above the base, and an inert gas disposed within the bulb.

93. The light bulb of example 92 wherein the inert gas is Argon.

94. The light bulb of example 93 wherein the Argon fills the bulb at a pressure of approximately 3 mm. In further examples, any pressure suitable for transferring heat away from the light emitting diode is acceptable.

95. The light bulb of example 92 and further comprising a second light emitting diode channel coupled to the light emitting diode circuitry and extending into the bulb above the base.

96. The light bulb of example 92 wherein the light emitting diode channel comprises multiple light emitting diode channels driven at approximately 12 watts and generating approximately 1600 lumens. 11 to 14 watts may be used in further embodiments.

97. The light bulb of example 92 wherein the light emitting diode channel is formed of light emitting diodes formed in an elongated rectangular form.

98. A light bulb comprising an Edison style base, light emitting diode circuitry coupled to the base, a bulb sealed about the base and extending above the base, an elongated filament substrate supported by the base and extending into the bulb above the base, and a light emitting diode channel supported by the filament substrate, coupled to the light emitting diode circuitry, and extending into the bulb above the base.

99. The light bulb of example 98 wherein the filament substrate is formed of ceramic.

100. The light bulb of example 99 wherein the filament substrate has a rectangular cross section with each of two opposite sides supporting a respective light emitting diode channel.

101. The light bulb of example 99 wherein the filament substrate has multiple sides in cross section and wherein two or more of the multiple sides each support a light emitting diode shaped in an elongated strip.

102. A light bulb comprising an Edison style base, light emitting diode circuitry coupled to the base, a bulb sealed about the base and extending above the base, an elongated filament substrate supported by the base and extending into the bulb above the base, a light emitting diode channel supported by the filament substrate, coupled to the light emitting diode circuitry, and extending into the bulb above the base, and an inert gas disposed within the bulb.

103. The light bulb of example 102 wherein the filament substrate is formed of ceramic.

104. The light bulb of example 103 wherein the filament substrate has a rectangular cross section with each of two opposite sides supporting a respective light emitting diode channel.

105. The light bulb of example 103 wherein the filament substrate has multiple sides in cross section and wherein two or more of the multiple sides each support a light emitting diode shaped in an elongated strip.

106. The light bulb of example 102 wherein the filament substrate is formed on a substantially transparent filament template.

107. The light bulb of example 106 wherein the substantially transparent filament template is formed from a transparent material.

108. The light bulb of example 107 wherein the transparent material is glass.

109. The light bulb of example 106 wherein the substantially transparent filament template comprises a support frame, an electric contact array supported by the support frame, a transparent filament array supported by the support frame, and a light emitting diode channel coupled to the electric contact array.

110. The light bulb of example 102, further including a light emitting diode circuitry substrate, wherein the light emitting diode circuitry is disposed on the light emitting diode circuitry substrate.

111. The light bulb of example 110, wherein the light emitting diode circuitry substrate is shaped like a doughnut and arranged around the filament substrate.

112. The light bulb of example 110, wherein the light emitting diode circuitry substrate is disposed within the base.

113. The light bulb of example 112, wherein the light emitting diode circuitry substrate is supported by the base and extends into the bulb above the base.

116. A light bulb comprising:

an Edison style base;

light emitting diode circuitry coupled to the base;

a bulb sealed about the base and extending above the base;

an elongated filament substrate supported by the base and extending into the bulb above the base; and a light emitting diode channel supported by the filament substrate, coupled to the light emitting diode circuitry, and extending into the bulb above the base.

117. The light bulb of example 116 wherein the filament substrate is formed of a transparent material.

118. The light bulb of example 116 wherein the filament substrate is formed of glass.

119. The light bulb of example 116 wherein the filament substrate is formed of porous glass.

120. The light bulb of example 119 and further comprising an inert gas disposed within the bulb.

121. The light bulb of example 116 wherein the filament substrate is formed of sapphire.

122. The light emitting diode of example 121 and further comprising an inert gas disposed within the bulb.

123. A light bulb comprising:

an Edison style base;

a bulb sealed about the base and extending above the base;

an elongated transparent filament substrate supported by the base and extending into the bulb above the base;

a light emitting diode channel supported by the filament substrate, coupled to the light emitting diode circuitry, and extending into the bulb above the base; and an inert gas disposed within the bulb.

124. The light bulb of example 123 wherein the filament substrate is formed of porous glass.

125. The light bulb of example 124 wherein the filament substrate has a rectangular cross section with each of two opposite sides supporting a respective light emitting diode channel.

126. The light bulb of example 123 wherein the filament substrate has multiple sides in cross section and wherein two or more of the multiple sides each support a light emitting diode shaped in an elongated strip.

127. The light bulb of example 123 wherein the transparent material is sapphire.

128. The light bulb of example 123 wherein multiple light emitting diode channels are supported by the filament substrate and coupled to the light emitting diode circuitry.

129. The light bulb of example 123, further including a light emitting diode circuitry substrate, wherein light emitting diode circuitry is disposed on the light emitting diode circuitry substrate.

What is claimed is:

1. A light bulb comprising:

an Edison style base;

light emitting diode circuitry coupled to the base;

a conductive structure including a first proximal contact that is proximate the base and a first distal contact that is distal from the base;

a bulb sealed about the base and extending above the base;

a substantially cylindrical elongated filament supported on a first proximate filament end by the first proximate contact and supported on a first distal filament end by the first distal contact, the filament extending from the base into the bulb above the base, wherein the bulb entirely encases the elongated filament;

a light emitting diode channel disposed within the filament, coupled to the light emitting diode circuitry, and extending into the bulb above the base; and an inert gas disposed within the bulb.

2. The light bulb of claim 1 wherein the inert gas comprises argon.

3. The light bulb of claim 1 wherein the filament includes a filament substrate formed of ceramic.

4. The light bulb of claim 3 wherein the filament substrate has a rectangular cross section with each of two opposite sides supporting a respective light emitting diode channel.

5. The light bulb of claim 1 further including a second filament, the second filament including a second light emitting diode channel shaped in an elongated strip disposed within the second filament; wherein:

the conductive structure includes a second proximal contact that is proximate the base and separated from the first proximate contact;

the second filament is supported on a second proximate filament end by the second proximate contact; and the second filament is supported on a second distal filament end by the first distal contact, the first filament and second filament converging on the first distal contact.

6. The light of claim 1 wherein the filament is formed of a substantially transparent material.

7. The light bulb of claim 6 wherein the transparent material is glass.

8. The light bulb of claim 6 wherein the filament includes a first filament conductor and a second filament conductor to contact the light emitting diode channel, the filament tapered on the first filament end to the first filament conductor and tapered on the second filament end to the second filament conductor.

9. The light bulb of claim 5, further including a third filament and a fourth filament, the first, second, third, and fourth filaments supported by the conductive structure and coupled to the light emitting diode circuitry, wherein:

the conductive structure includes a second distal contact that is distal from the base and separated from the first distal contact;

the third filament is supported by the second proximal contact and the second distal contact; and the fourth filament is supported by the second distal contact and the first proximal contact, the third filament and fourth filament converging on the second distal contact.

10. The light bulb of claim 3 wherein the filament substrate has a first side and a second side opposite the first side, and wherein each side supports a light emitting diode channel, each channel having multiple light emitting diodes positioned in a staggered manner with respect to the light emitting diodes in the other channel to facilitate light transmission from each diode away from both sides of the filament substrate.

11. The light bulb of claim 1, further including a light emitting diode circuitry substrate, wherein the light emitting diode circuitry is disposed on the light emitting diode circuitry substrate.

12. The light bulb of claim 11, wherein the light emitting diode circuitry substrate is shaped like a doughnut and arranged around the filament substrate.

13. The light bulb of claim 11 wherein the light emitting diode circuitry substrate is substantially transparent.

14. The light bulb of claim 11, wherein the light emitting diode circuitry substrate is disposed within the base.

15. The light bulb of claim 14, wherein the light emitting diode circuitry substrate is supported by the base and extends into the bulb above the base.

16. A light bulb comprising:

an Edison style base;

light emitting diode circuitry coupled to the base;

a conductive structure including a first proximal contact that is proximate the base and a first distal contact that is distal from the base;

a bulb sealed about the base and extending above the base;

a substantially cylindrical elongated filament supported on a first proximate filament end by the first proximate contact and supported on a first distal filament end by the first distal contact, the filament extending from the base into the bulb above the base, wherein the bulb entirely encases the elongated filament; and a light emitting diode channel disposed within the filament, coupled to the light emitting diode circuitry, and extending into the bulb above the base.

17. The light bulb of claim 16 wherein the filament is formed of a transparent material.

18. The light bulb of claim 16 wherein the filament is formed of porous glass.

19. A light bulb comprising:

an Edison style base;

a bulb sealed about the base and extending above the base;

a conductive structure including a first proximal contact that is proximate the base and a first distal contact that is distal from the base;

a substantially cylindrical elongated filament supported on a first proximate filament end by the first proximate contact and supported on a first distal filament end by the first distal contact, the filament extending from the base into the bulb above the base, wherein the bulb entirely encases the elongated filament;

a light emitting diode channel including light emitting diodes disposed within the filament and extending into the bulb above the base; and an inert gas disposed within the bulb.

20. The light bulb of claim 19 wherein the filament is formed of porous glass.

* * * * *